US008062077B2

(12) United States Patent
Hayashi et al.

(10) Patent No.: US 8,062,077 B2
(45) Date of Patent: Nov. 22, 2011

(54) PUSH-TYPE CONNECTOR

(75) Inventors: Tatsuya Hayashi, Higashine (JP); Takayuki Nagumo, Hachioji (JP)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 12/989,106

(22) PCT Filed: Mar. 24, 2009

(86) PCT No.: PCT/US2009/038072

§ 371 (c)(1),
(2), (4) Date: Oct. 22, 2010

(87) PCT Pub. No.: WO2009/131784

PCT Pub. Date: Oct. 29, 2009

(65) Prior Publication Data

US 2011/0039455 A1 Feb. 17, 2011

(30) Foreign Application Priority Data

Apr. 25, 2008 (JP) ..... 2008-116202

(51) Int. Cl.
*H01R 4/48* (2006.01)

(52) U.S. Cl. ..... 439/725; 439/835

(58) Field of Classification Search ..... 439/725, 439/835, 709, 441

See application file for complete search history.

(56) References Cited

U.S. PATENT DOCUMENTS

| | | | | |
|---|---|---|---|---|
| 5,810,625 | A * | 9/1998 | Klein et al. | 439/709 |
| 6,341,989 | B1 * | 1/2002 | Jaag | 439/725 |
| 6,595,809 | B2 * | 7/2003 | Matsumoto et al. | 439/835 |
| 6,666,707 | B2 * | 12/2003 | Moret Codina | 439/441 |
| 2003/0008569 | A1 * | 1/2003 | Matsumoto et al. | 439/835 |

FOREIGN PATENT DOCUMENTS

| | | |
|---|---|---|
| JP | 7-183059 | 7/1995 |
| JP | 11-086939 | 3/1999 |
| JP | 2001-338703 | 12/2001 |
| JP | 2005-302608 | 10/2005 |
| JP | 2006-351490 | 12/2006 |

OTHER PUBLICATIONS

International Search Report for PCT/US2009/038072, pp. 4.

* cited by examiner

*Primary Examiner* — Gary F. Paumen
(74) *Attorney, Agent, or Firm* — Robert S. Moshrefzadeh

(57) ABSTRACT

Provided is a push-type connector having a structure for preventing an operational error of a lever member of the connector by an operator. A first operating part 35*a* of a first lever member 3*a* at a first position is positioned anterior to a second operating part 35*b* of a second lever member 3*b* at a third position, in relation to the pushing direction of the lever. Further, first operating part 35*a* of first lever member 3*a* projects further than second operating part 35*b* of second lever member 3*b* in the direction toward the front end of the lever or the operator side. Therefore, second lever member 3*b* is not likely to be an obstacle to the operation of first lever member 3*a*, and first lever member 3*a* is not likely to be an obstacle to the operation of second lever member 3*b*.

6 Claims, 7 Drawing Sheets

PUSH-TYPE CONNECTOR

CROSS REFERENCE TO RELATED APPLICATIONS

This application is a national stage filing under 35 U.S.C. 371 of PCT/US2009/038072, filed Mar. 24, 2009, which claims priority to Japanese Application No.2008-116202, filed Apr. 25, 2008, the disclosure of which is incorporated by reference in its/their entirety herein.

FIELD

The present invention relates to a push-type connector for electrically connecting a cable conductor or a lead attached to an end of a cable and a substrate by operating a push-type lever.

BACKGROUND

A so-called push-type connector has a push-type lever, an insertion hole and a connecting terminal therein. A cable conductor or a lead terminal attached to an end of a cable may be inserted into the insertion hole and connected to the connecting terminal. Such a push-type connector is, for example, used on the back side of an audio instrument and, in many cases, a plurality of the connectors are aligned. For example, Patent Document 1 (Japanese Unexamined Patent Publication (Kokai) No. 7-183059) describes that "When a lead "A" is connected to a first clamp portion 20, as shown in FIG. 3(*b*), a lever 3 is inclined on a seat member 2 about a rear edge 15*a* of a pressure contact portion 15 in order to raise a sliding shaft 4. Therefore, first and second holes 5 and 13 are aligned and lead "A" may be inserted into holes 5 and 13".

SUMMARY

In recent years, a push-type connector is required to be more compact because an apparatus including the connector becomes downsized and complicated. In order to downsize the connector while maintaining the number of terminals, a push lever for opening an insertion hole of each terminal inevitably becomes compact and the distance between neighboring levers becomes short. Therefore, even if an operator wants to operate only a specific lever, a finger of the operator may contact a neighboring lever. As a result, an insertion hole, which is not necessary to be opened, may be opened and a cable conductor or a lead terminal in the hole may be detached from the hole. Accordingly, it is desired to provide a compact connector in which an operator hardly makes an operational error.

The present invention thus provides a push-type connector having a structure for preventing an operational error of a lever by an operator.

To achieve an object of the invention described above, one embodiment of the present invention provides a push-type connector comprising: a first connecting terminal for electrically connecting a first lead; a first lever member capable of moving between a first position where the first lever member and the first connecting terminal cooperatively hold the first lead and a second position where the first lead is released, the first lever member having an accessible first operating surface; a first biasing member for biasing the first lever member toward the first position; a second connecting terminal for electrically connecting a second lead; a second lever member capable of moving between a third position where the second lever member and the second connecting terminal cooperatively hold the second lead and a fourth position where the second lead is released, the second lever member having an accessible second operating surface; a second biasing member for biasing the second lever member toward the third position; wherein the first operating surface of the first lever member at the first position is positioned anterior to the second operating surface of the second lever member at the third position in relation to the direction in which the second lever member moves from the third position to the fourth position.

According to one embodiment of the present invention, when the operator operates the first lever member or the second lever member, another lever member does not interfere with the lever being operated, whereby an operational error by the operator may be prevented.

EXPLANATION OF THE REFERENCE NUMERALS

1 connector
2 housing
3*a* first lever member
3*b* second lever member
35*a* first operating part
35*b* second operating part
351*a* first operating surface
351*b* second operating surface
4*a* first connecting terminal
4*b* second connecting terminal
5*a* first biasing member
5*b* second biasing member

DETAILED DESCRIPTION

Figure 1:
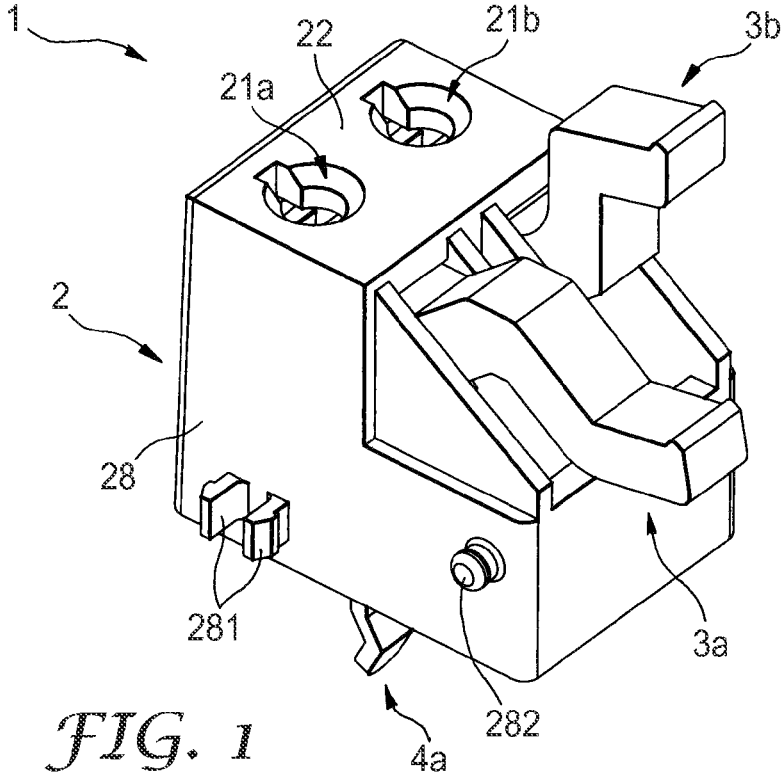
FIG. 1 A perspective view showing a push-type connector according to one embodiment of the present invention.
Figure 2:
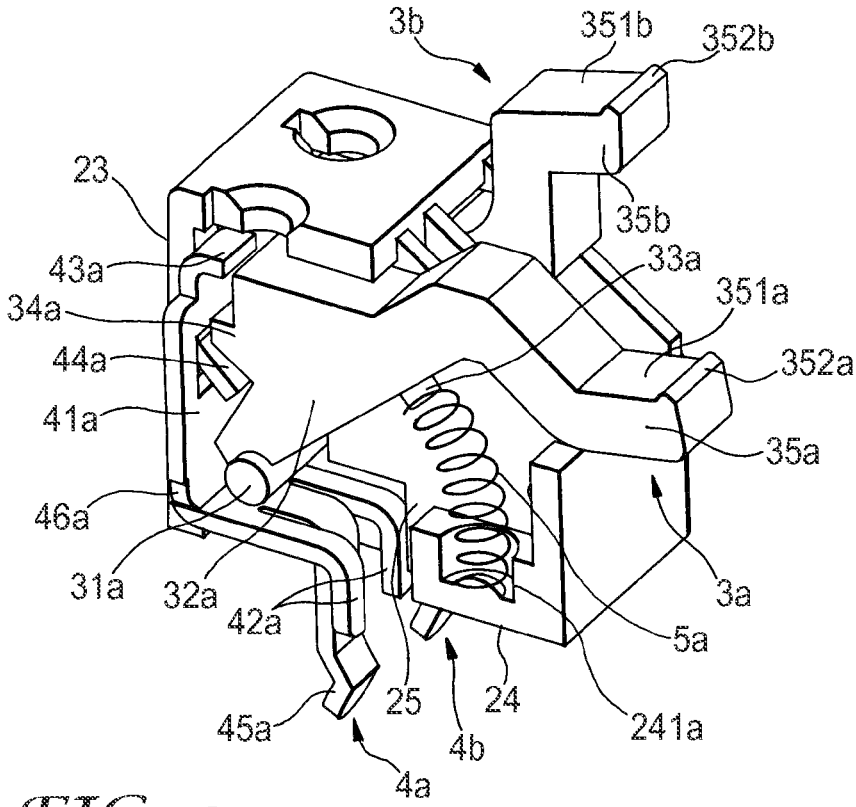
FIG. 2 A view showing an inner structure of the connector of FIG. 1 by removing a part of the connector.

FIG. 1 is a perspective view of a preferable embodiment of a push-type connector 1 (hereinafter, merely referred to as "connector"). FIG. 2 is a view showing connector 1, a part of which is removed for clarifying the inside thereof. Connector 1 has a housing 2, first and lever members 3*a* and 3*b* movably arranged in housing 2, first and second connecting terminals 4*a* and 4*b* made from conductive material (as for second terminal 4*b*, a part of which is shown in FIG. 2), and first and second biasing members for biasing first and second lever members 3*a* and 3*b*, respectively (only first biasing member 5*a* is shown in FIG. 2). Housing 2 may be made from arbitrary material such as metal or resin. As shown in FIG. 1, housing 2 has insertion holes 21*a* and 21*b* at a top surface 22 thereof, through which a cable conductor or a lead terminal attached to an end of a cable to be connected to each connecting terminal in the housing (hereinafter, merely referred to as "lead") ma be inserted.

Figure 4:
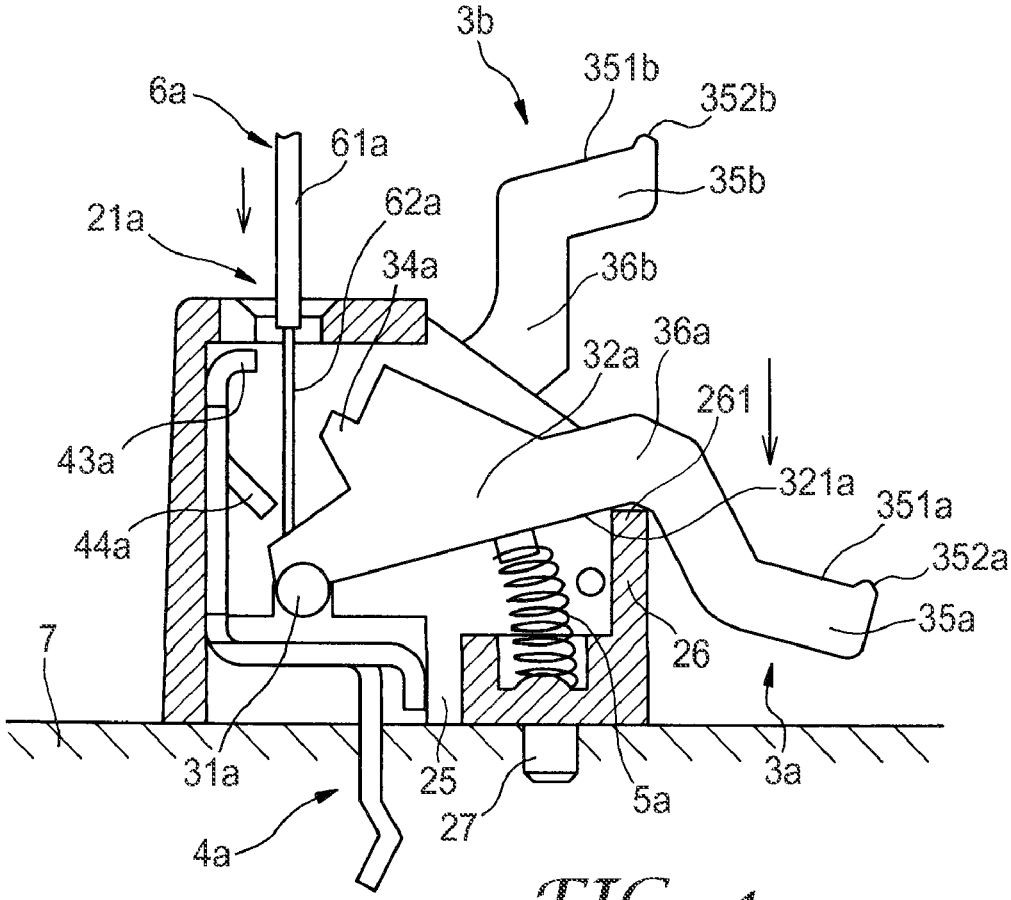
FIG. 4 A side cross sectional view of the connector in which a first lever member is pushed down and positioned at a second position.

First connecting terminal 4*a* may be made by bending and/or punching a metal plate such as a copper sheet. First connecting terminal 4*a* has generally a L-shape provided with a back side portion 41*a* and a bent leg portion 42*b*. By contacting back side portion 41*a* to an inner surface of a back side part 23 of housing 2 and by contacting leg portion 42*a* to a shoulder part 25 of housing 2, first connecting terminal 4*a* may be fixed to housing 2. Connecting terminal 4*a* further has two projections 43*a* and 44*a* for contacting a first lead 6*a* inserted into through hole 21*a*. Projections 43*a*, 44*a* may be formed by bending and/or punching a part of the metal plate and are separated from each other by a certain distance in the longitudinal direction of first lead 6*a*. Connecting terminal 4*a* further has a tail portion 45*a* projecting from a bottom part 24 of housing 2 (or a housing surface connected to a substrate 7 as schematically shown in FIG. 4). Tail portion 45*a* may be electrically connected to a through hole (not shown) formed on substrate 7 by soldering, etc. Alternatively, leg portion 42*a* of the connecting terminal may be bent such that the leg portion extends parallel to the substrate for performing surface mounting, and the leg portion may be electrically connected to a conductive part (or a land) on the substrate by soldering, etc.

Figure 3:
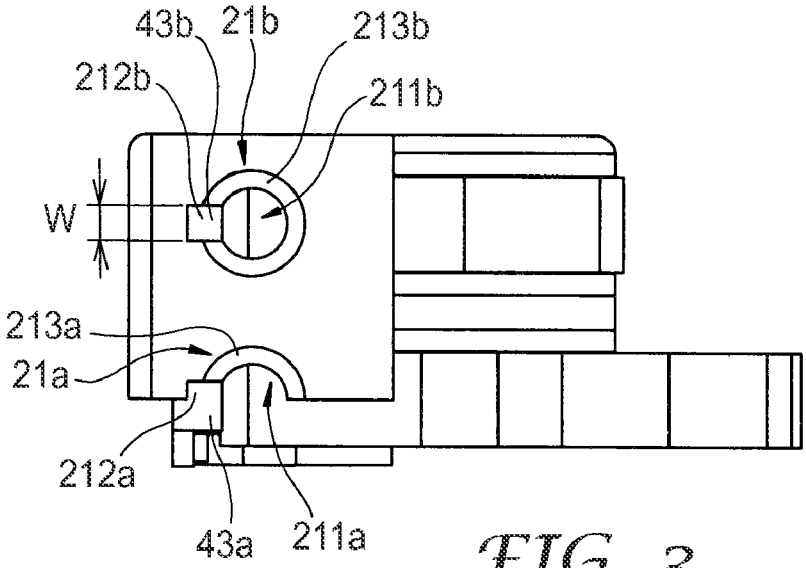
FIG. 3 A top view of the connector of FIG. 2.

FIG. 3 is a top view of the constitution of FIG. 2. Insertion holes 21*a* and 21*b* have cable through parts 211*a* and 211*b*, probe through parts 212*a* and 212*b* communicated with the cable through parts, respectively. Cable through parts 211*a* and 212*b* are generally circular through holes having inclined surfaces 213*a* and 213*b*, respectively, at one end thereof near top surface 22. The diameter of each cable through part is somewhat larger than the outer diameter of the cable to be inserted in to the cable through part. On the other hand, the probe through parts are generally rectangular holes each having the width W which is smaller than the diameter of the cable through part. The width W may be smaller than the diameter of a conductor of the cable inserted into the through hole. Within housing 2 just below insertion holes 21*a* and 21*b*, projections 43*a* and 43*b* of connecting terminals 4*a* and 4*b* are positioned. Viewed from the top surface of housing 2, the front end of each projection is positioned generally on the circumference of the circular through hole.

While the cable is inserted in to the through hole, a probe of a tester or the like may be inserted into each of probe through parts 212*a* and 212*b* and connected to the projection of the connecting terminal, whereby a conductive state between connector 1 and the cable connected to connector 1 may be examined. Since the width W is smaller than the diameter of the cable through part, the front end of the cable is not likely to be accidentally inserted into the probe through part when the cable should be inserted into the cable through part. Therefore, the workability of inserting the cable may be enhanced. If the width W is smaller than the diameter of the conductor of the cable, the false insertion of the cable may be more effectively prevented. Further, since the cable through part is visually larger than the probe through part, the operator can easily identify the cable through part from the probe through parts.

First lever member 3*a* is configured to pivot about a support shaft 31*a* thereof between a first position as shown in FIG. 2 and a second position as shown in FIG. 4. Support shaft 31*a* is positioned near and inside a bend portion 46*a* of connecting terminal 4*a* having generally a L-shape. First lever member 3*a* has a body part 32*a* extending from support shaft 31*a* and opposite to terminal 4*a*, and a protrusion 33*a* formed on body part 32*a* and apart from shaft 31*a* in the longitudinal direction of the lever member. First biasing member 5*a* such as a coil spring has one end engaged with protrusion 33*a* and opposite end received in a coil spring receiving hole 241*a* formed on bottom part 24 of housing 2, whereby the first biasing member biases lever member 3*a* toward the first position. Therefore, first lever member 3*a* is positioned at the first position as shown in FIG. 2 when the lever member is not operated by the operator. At the first position, a wedge part 34*a* of lever member 3*a*, formed near two projections 43*a*, 44*a* of first connecting terminal 4*a*, is positioned between the two projections.

First and second biasing members may be an elastic member other than the coil spring, such as a tension spring, a plate spring or rubber. Alternatively, a part of the connecting terminal may be formed as a plate spring, or, a part of the lever member or the housing may be deformable, so as to utilize the part as a biasing member.

Figure 5:
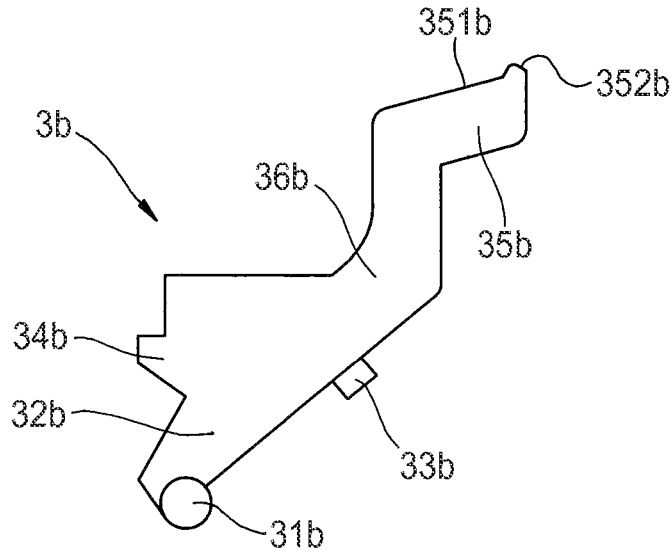
FIG. 5 A view showing a second lever member.

FIG. 4 is a sectional side view of connector 1 showing the state in which the first lever member is positioned at the second position (where the insertion hole is opened). First lever member 3*a* has an operating part 35*a* integrally formed at the end of body part 32*a* via connecting part 36*a*, operating part 35*a* having an operating surface 351*a* accessible by the operator. Similarly, as shown in FIG. 5, second lever member 3*b* has an operating part 35*b* integrally formed at the end of body part 32*b* (similar to body part 32*a* of the first lever member) via connecting part 36*b*, operating part 35*b* having an operating surface 351*b* accessible by the operator. Connecting part 36*a* of the first lever member is downwardly bent from the end of body part 32*a*, on the other hand, connecting part 36*b* of the second lever member is upwardly bent from the end of body part 32*b*. By bending two lever members in opposite directions in such a manner, the total height of the connector may be lowered while maintaining a stroke of each lever member, whereby the connector may be effectively compact. Further, a gap, into which the finger of the operator may be inserted, may be formed between the first and second lever members. Therefore, the first lever member may be easily operated even if the first lever member does not widely protrude forward, whereby the connector may also be compact.

As shown in FIG. 5, second lever member 3*b* may have the shape similar to the first lever member, except a part from connecting part 36*b* to the front end (or operating part 35*b*). In other words, a support shaft 31*b*, a body part 32*b*, a protrusion 33*b* and a wedge part 34*b* of the second lever member may be similar to support shaft 31*a*, body part 32*a*, protrusion 33*a* and wedge part 34*a* of the first lever member, respectively.

As the operator pushes down operating surface 351*a* of first lever member 3*a* at the first position, body part 32*a* is rotated about support shaft 31*a*, and then, a lower surface 321*a* of body part 32*a* contacts an upper end 261 of a front wall 26 of housing 2, whereby first lever member 3*a* is stopped. In the illustrated embodiment, the position where the first lever member is stopped is explained as the second position. However, the second position may be another position in so far as first lever member 3*a* and connecting terminal 4*a* do not cooperatively hold lead 6*a* (i.e., the lead may be inserted into or withdrawn from insertion hole 21*a*). Therefore, the second position may be somewhat near the first position, in comparison with the position as shown in FIG. 4. The same may be applied to second lever member 3*b*. In other words, the position where the second lever member is stopped or contacts the housing or the like may be defined as a fourth position. However, in so far as second lever member 3*b* and connecting terminal 4*b* do not cooperatively hold a lead, the fourth position may be somewhat near a third position.

Instead of stopping the lever member by contacting the lower surface of the lever member to the housing, the housing may have a protrusion (not shown) configured to contact a protrusion (not shown) formed on the lateral side or the lower surface of the lever member in order to stop the lever member.

In the second position, a gap is formed between projections 43*a*, 44*a* of connecting terminal 4*a* and wedge part 34*a* of first lever member 3*a*. Then, as shown in FIG. 4, lead 6*a*, including a core fiber 62*a* having a predetermined length formed by removing a jacket 61*a* from the lead, may be inserted into insertion hole 21*a*. Housing 2 may have a positioning pin 27 downwardly extending from the bottom part of the housing. By engaging pin 27 with a through hole formed on substrate 7 (FIG. 4), connector 1 may be correctly positioned on the substrate. In addition, operating surfaces 351*a* and 351*b* may be burred or have a plurality of grooves as a slip stopper.

Figure 6:
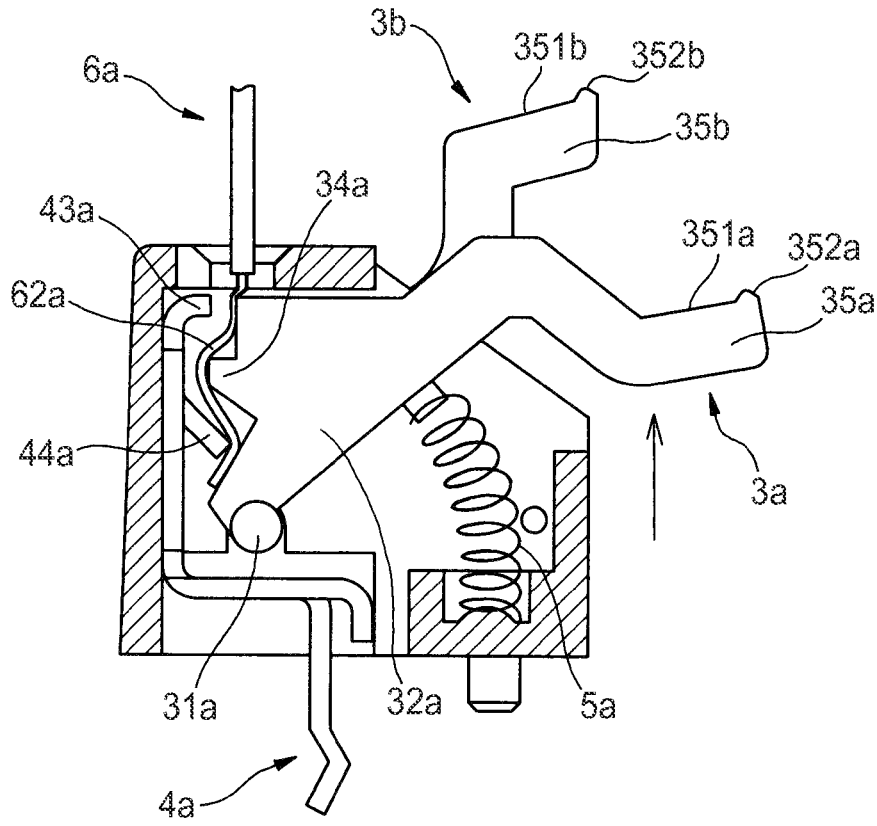
FIG. 6 A side cross sectional view of the connector in which the first lever member is returned to a first position.

Next, as shown in FIG. 6, the finger of the operator is separated from operating surface 351*a*, body part 32*a* of the first lever member is rotated about support shaft 31*a* in the direction opposite to the direction of FIG. 4 and returns to the first position (where the insertion hole is closed). Since wedge part 34*a* of first lever member 3*a* is positioned between the two projections of the terminal at the first position, core fiber 62*a* of first lead 6*a* is sandwiched and bent between the two projections and the wedge part. Accordingly, core fiber 62*a* may be electrically connected to at least one of projections 43*a* and 44*a*.

Figure 7:
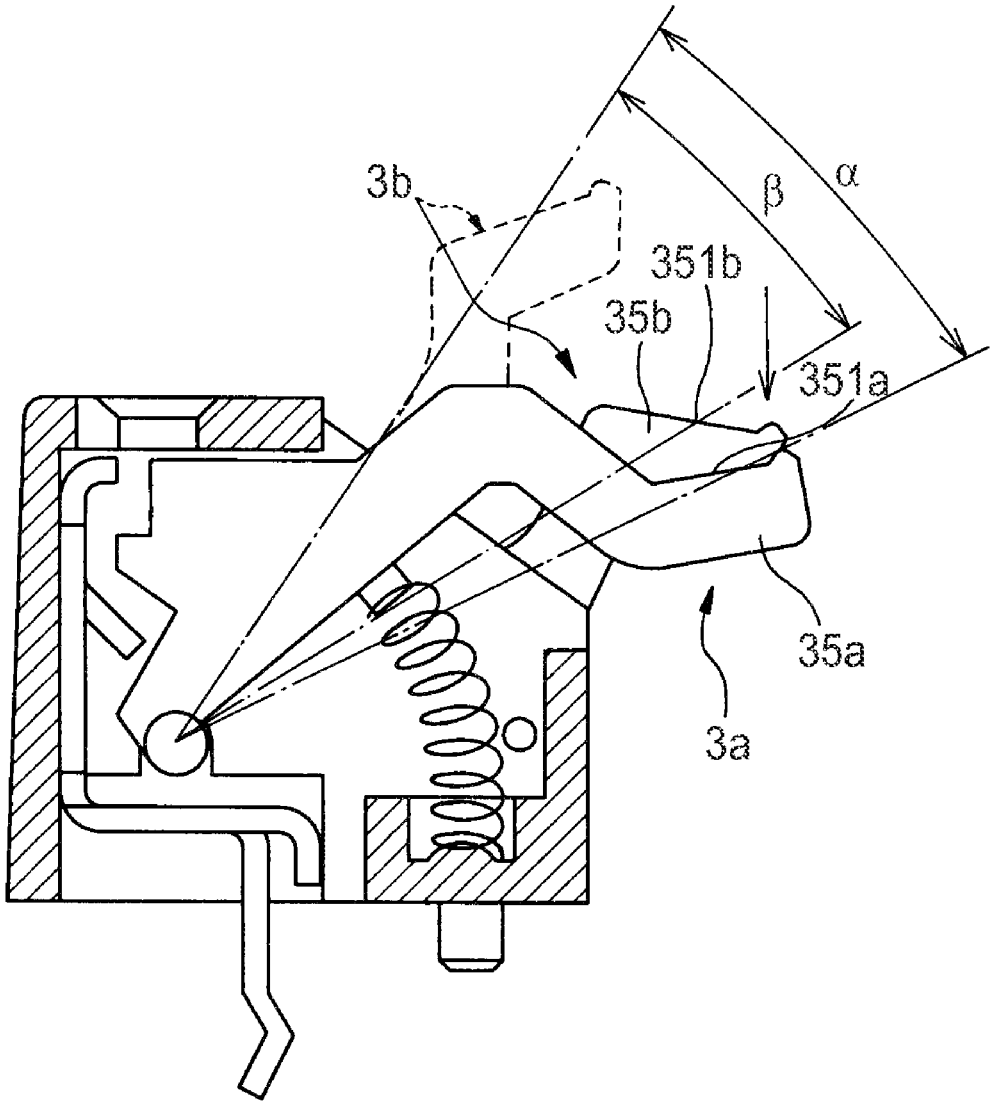
FIG. 7 A side cross sectional view of the connector in which the second lever member is pushed down and positioned at a fourth position.

Second connecting terminal 4*b* and second biasing member, associated with second lever member 3*b*, may have the constitutions similar to first connecting terminal 4*a* and first biasing member 5*a*, respectively. Therefore, second lever member 3*b* may pivot between a third position (where the lever is not operated by the operator and the insertion hole is closed, as shown in FIGS. 2 to 6) and a fourth position (where the lever is pushed down by the operator and the insertion hole is opened, as shown in FIG. 7). Even if second connecting terminal 4*b* and second biasing member have the constitutions somewhat different configured from first connecting terminal 4*a* and first biasing member 5*a*, respectively, the second connecting terminal and the second biasing member are configured such that a second lead (not shown) may be inserted into insertion hole 21*b* of housing 2 when operating part 35*b* of lever member 3*a* is pushed down, and then, the second lead and connecting terminal 4*b* are electrically connected each other when lever member 3*b* is returned to the third position by a biasing force generated by the second biasing member.

The constitution of each lever member will be explained. As shown in FIGS. 2 to 6, operating part 35*a* of first lever member 3*a* is somewhat bent in the direction toward the second position from the first position (in the downward direction in the figure). On the other hand, operating part 35*b* of second lever member 3*b* is somewhat bent, relative to a body part 32*b* similar to body part 32*a*, in the direction toward the third position from the fourth position (in the upward direction in the figure). The operating surfaces of the both levers are generally perpendicular to the direction in which the levers may be pushed (in this case, the direction generally perpendicular to substrate 7) such that the operator may easily operate the levers. At the front edges of operating surfaces 351*a* and 351*b*, projections 352*a* and 352*b* are formed, respectively, in order to avoid that the finger of the operator slips on the operating surface while operating. The projections may have arbitrary shape so long as each projections has the slip-avoiding function, and the illustrated projection is formed as a ridge having the height of 1-2 mm and extending across the width of the lever. Further, when each projection is configured to be upwardly inclined than the horizontal direction at the second or fourth position (where the lever is pushed down), the slip of the finger may be effectively avoided.

As shown in FIG. 6, operating part 35*a* of first lever member 3*a* at the first position is positioned anterior (downward in the figure) to second operating part 35*b* of second lever member 3*b* at the third position in relation to the direction in which the second lever member moves from the third position to the fourth position. Also, first operating part 35*a* of first lever member 3*a* at the first position extends towards the operator side or the front end side of the lever more than second operating part 35*b* of second lever member 3*b* at the third position. In more detail, first operating surface 351*a* of the first lever member projects more than second operating surface 352*b* of the second lever member in relation to a plane which is parallel to both the direction in which the pushing-down direction of each lever member and the arraying direction of the first and second lever members. In this embodiment, the pushing-down direction means a component generally perpendicular to substrate 7 (FIG. 4) of the direction in which the first lever member or the second lever member moves from the first position to the second position or from the third position to the fourth position. In FIG. 6, the direction component is the downward direction. In this embodiment, the arraying direction of the first and second lever members corresponds to the axial direction of support shaft 31*a* or 31*b* of the lever member. Due to this configuration, second lever member 3*b* is not likely to be an obstacle to the operation of first lever member 3*a*, and the first lever member is not likely to be an obstacle to the operation of the second lever member. Therefore, the operator may easily operate only first lever member 3*a* as shown in FIG. 4, and may easily operate only second lever member 3*b* as shown in FIG. 7.

FIG. 7 shows the state in which only second lever member 3*b* is pushed down, i.e., first lever member 3*a* is positioned at the first position and second lever member 3*b* is positioned at the fourth position. Second operating surface 351*b* of the second lever member at the fourth position is positioned at the same level as or posterior to (or the upper side in the embodiment of FIG. 7) first operating surface 351*a* of the first lever member at the first position. In other words, when an angle $\alpha$, formed by a line extending from shaft 31*a* of the first member to a site on operating surface 351*a* at the first position which the finger of the operator contacts and a line extending from a shaft of the second lever member (in FIG. 7, positioned at the same position as shaft 31*a*) to a site on operating surface 351*b* at the third position which the finger of the operator contacts, is equal to or larger than an angle $\beta$ between the third and fourth position of the second member, the advantageous effect of the invention may be obtained. Even when operating part 35*b* of the second lever member is fully pushed down to the fourth position, it is highly unlikely that the finger of the operator pushing down operating surface 351*b* interferes with operating surface 351*a*, whereby the possibility of an operational error of the first lever member may be further reduced. From the state of FIG. 7, the operator inserts a second lead (not shown) into insertion hole 21*b* of housing 2 (see FIG. 1) and then releases the hand from the second lever member, whereby the second lever member is returned to the third position and the second lead is electrically connected to second connecting terminal 4*b*. Since such a series of operations may be the same as in the case of the first lever member, as shown in FIGS. 4 and 6, the detailed explanation of the operations is omitted.

Figure 8:
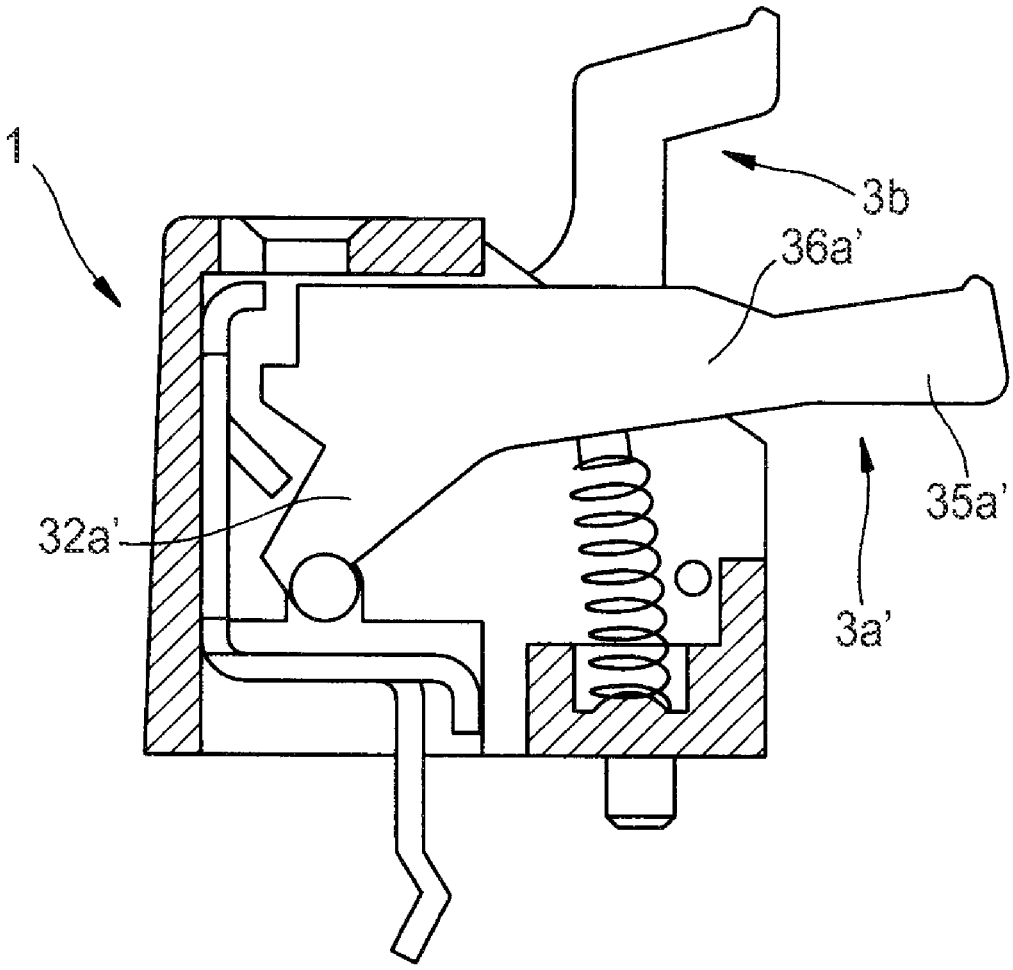
FIG. 8 A view showing a modification of the connector of the invention.

FIG. 8 is a side view showing a modification of the connector of the invention. This modification is different from the above embodiment in that a connecting part 36*a*' of a first lever member 3*a*' thereof is not bent and connects a body part 32*a*' and an operating part 35*b*' such that the body part and the operating part cooperatively form generally a straight member. In other respects, the modified connector may be the same as connector 1 as described above. Although not shown in the drawings, a second lever member may be formed as generally a straight member like first lever member 3*a*' and a first lever member may have a connecting part which is downwardly bent, as in first lever member 3*a*.

Figure 9:
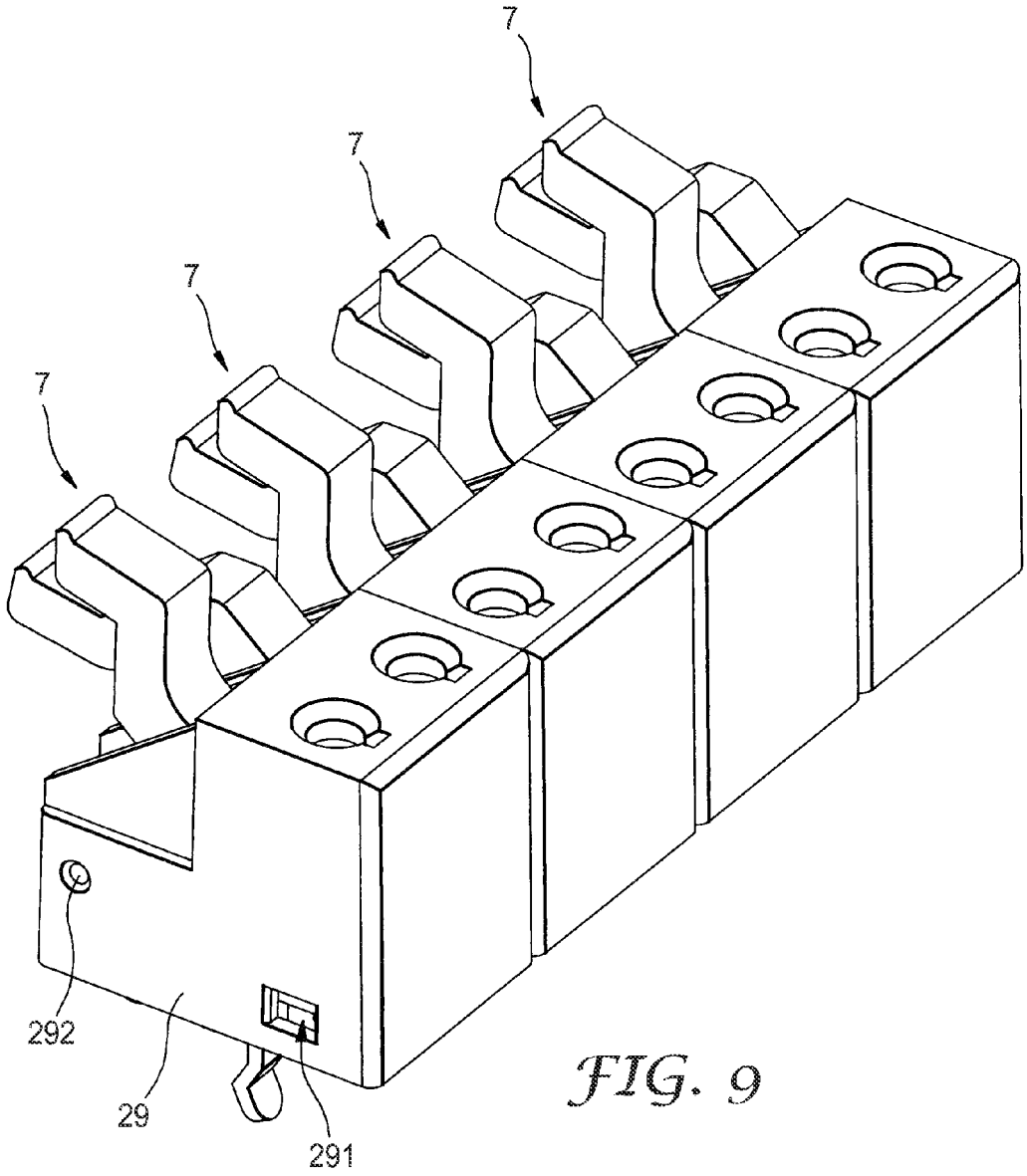
FIG. 9 A perspective view showing the configuration in which a plurality of the connectors of FIG. 1 are aligned.

FIG. 9 shows a constitution in which a plurality of connectors 1 are aligned. As shown in FIG. 1, housing 2 of connector 1 has a latch member 281 and a positioning member or pin 282 on one side 28 thereof. Further, as shown in FIG. 9, housing 2 has a latch hole 291 capable of engaging with latch member 281 and a positioning hole 292 capable of engaging with positioning pin 282. When positioning pin 282 is not formed as a simple cylindrical shape and has a bulge portion at the front end thereof, the pin is not easily detached from positioning hole 292 after the engagement. It is preferable that latch 281 and pin 282 are configured to be detached from latch hole 291 and positioning hole 292, respectively, when an external force larger than a certain level is applied to each of the latch and the pin. By utilizing such a structure arranged on the side of the housing, a plurality of connectors may be aligned in a line, whereby a terminal block for a plurality of leads may be constituted.

In the illustrated embodiment, connector 1 has two connecting terminals, two lever members and two biasing members. However, the connector may have one connecting terminal, one lever member and one biasing member, or, three or more connecting terminals, three or more lever members and three or more biasing members.

Figure 10:
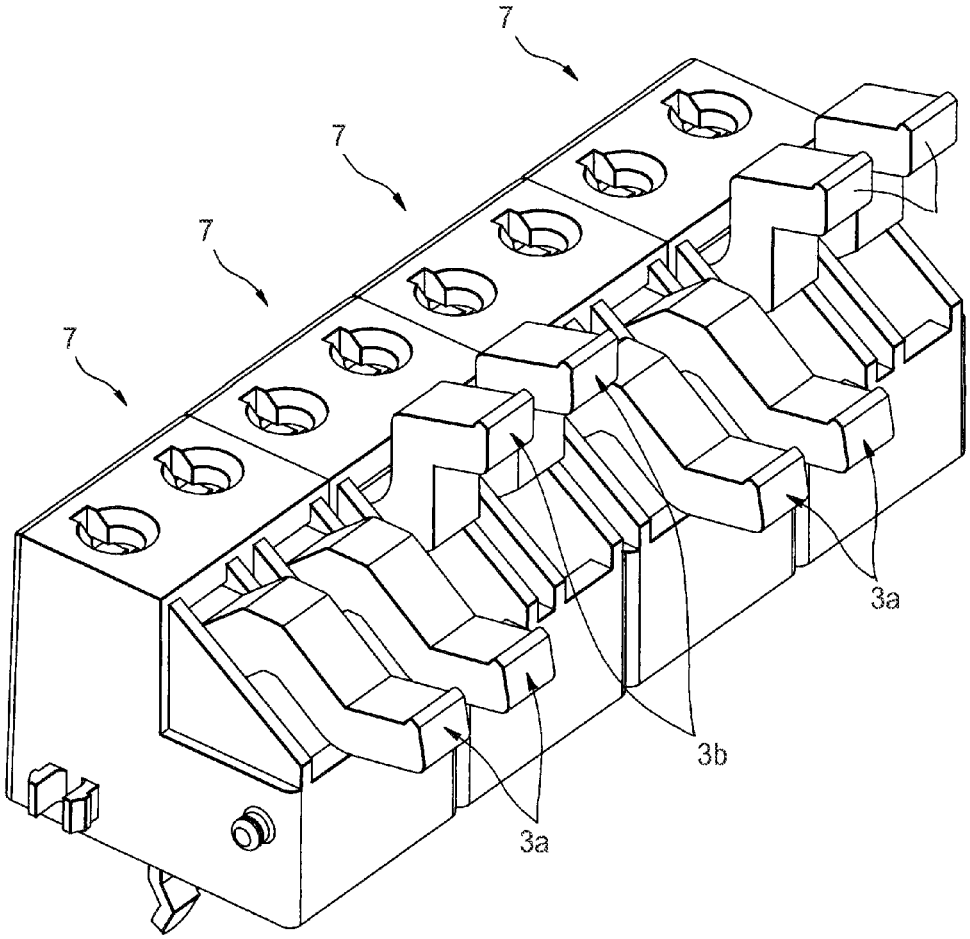
FIG. 10 A perspective view showing a modification of the configuration of FIG. 9.

FIG. 10 shows a modification of the constitution of FIG. 9. A certain type of lead wire, to be connected to a push-type connector, includes two core fibers. In such a case, it is preferable that the two core fibers may be simultaneously held or released by or from the connector. Accordingly, as shown in FIG. 10, by alternately aligning a connector 1' having two first lever members 3*a* and a connector 1" having two second lever members 3*b*, a lead may be easily connected or disconnected to or from each connector, and a lever member neighboring a lever member to be operated may be prevented from being accidentally operated.

In the embodiment of FIG. 10, when the lever members should be operated one by one, one lever member among two lever members neighboring a lever member to be operated is offset from the lever member to be operated. Therefore, the possibility of the operational error may be reduced to some degree.

What is claimed is:

1. A push-type connector comprising:

a first connecting terminal for electrically connecting a first lead;

a first lever member capable of moving between a first position where the first lever member and the first connecting terminal cooperatively hold the first lead and a second position where the first lead is released, the first lever member having an accessible first operating surface;

a first biasing member for biasing the first lever member toward the first position;

a second connecting terminal for electrically connecting a second lead;

a second lever member capable of moving between a third position where the second lever member and the second connecting terminal cooperatively hold the second lead and a fourth position where the second lead is released, the second lever member having an accessible second operating surface;

a second biasing member for biasing the second lever member toward the third position;

wherein the first operating surface of the first lever member at the first position is positioned anterior to the second operating surface of the second lever member at the third position in relation to the direction in which the second lever member moves from the third position to the fourth position.

2. The push-type connector according to claim 1, wherein the first operating surface of the first lever member at the first position is positioned at the same level as or anterior to the second operating surface of the second lever member at the fourth position in relation to the direction in which the second lever member moves from the third position to the fourth position.

3. The push-type connector of claim 1, wherein the first operating surface of the first lever member at the first position projects more than the second operating surface of the second lever member at the third position in relation to a plane which is parallel to both the direction in which the first lever member moves from the first position to the second position and the arraying direction of the first and second lever members.

4. The push-type connector of claim 1, wherein the first and second lever members are alternately aligned.

5. The push-type connector of claim 1, wherein a set of two first lever members and a set of two second lever members are alternately aligned.

6. The push-type connector of claim 1, wherein each of the first and second operating surfaces has a protrusion formed at the front end of each operating surface.

* * * * *